US008424211B2

(12) United States Patent
Nene et al.

(10) Patent No.: US 8,424,211 B2
(45) Date of Patent: Apr. 23, 2013

(54) SEPARABLE SCISSORS WITH ELASTIC STOPPERS

(75) Inventors: Lucas O Nene, Erie, PA (US); Thomas William Hartman, Pittsburgh, PA (US); Evan Mark Abel, Rockaway Park, NY (US); Frank J. Clementi, Somerset, PA (US)

(73) Assignee: Helen of Troy Limited, Belleville St. Michael (BB)

( * ) Notice: Subject to any disclaimer, the term of this patent is extended or adjusted under 35 U.S.C. 154(b) by 459 days.

(21) Appl. No.: 12/872,607

(22) Filed: Aug. 31, 2010

(65) Prior Publication Data

US 2012/0047751 A1 Mar. 1, 2012

(51) Int. Cl.
*B26B 13/04* (2006.01)

(52) U.S. Cl.
USPC ..... 30/254; 30/244

(58) Field of Classification Search ..... 30/173–181, 30/186–194, 234–239, 244–262; 81/415–417
See application file for complete search history.

(56) References Cited

U.S. PATENT DOCUMENTS 1,165,226 A * 12/1915 Cassady ..... 30/120
1,931,576 A * 10/1933 De Neui ..... 72/409.02
2,528,326 A * 10/1950 Vosbikian et al. ..... 30/260
2,619,965 A * 12/1952 Goldstone ..... 606/118
2,676,404 A * 4/1954 Peckron et al. ..... 30/261
2,827,815 A * 3/1958 Smoyak ..... 81/417
3,325,897 A * 6/1967 Luebkeman ..... 30/254
3,376,641 A * 4/1968 Usborne ..... 30/266
4,528,707 A * 7/1985 Aida ..... 7/131
5,065,516 A * 11/1991 Dulebohn ..... 30/245
5,469,626 A * 11/1995 Vogel et al. ..... 30/266
5,893,307 A * 4/1999 Tao ..... 81/427
7,210,230 B2 * 5/2007 Wurzel ..... 30/260
7,458,160 B2 * 12/2008 Escobar et al. ..... 30/232
7,694,423 B2 * 4/2010 Hasegawa ..... 30/232
2005/0283980 A1 * 12/2005 Bathard et al. ..... 30/131
2010/0263216 A1 * 10/2010 Hanakawa ..... 30/254

OTHER PUBLICATIONS

International Search Report and Written Opinion of PCT/US2011/045682 dated Jan. 3, 2012.

* cited by examiner

*Primary Examiner* — Kenneth E. Peterson
*Assistant Examiner* — Lisandra Colon-Rodriguez

(57) ABSTRACT

A pivoting hand tool is provided including handle structures which control the relative angular position of pivotable arms to allow disassembly and reassembly and to prevent accidental disassembly during use. Handle structures includes an elastic interference portion which provides a first interference between the first arm and second arm at the predetermined angle to prevent angular displacement of the arms from exceeding a first predetermined angle until a disassembly pivoting force is applied to the first arm and the second arm.

20 Claims, 4 Drawing Sheets

SEPARABLE SCISSORS WITH ELASTIC STOPPERS

FIELD OF THE INVENTION

The present invention relates to pivoting hand tools, and more particularly to a disassemblable and assemblable scissors and the like.

BACKGROUND OF THE INVENTION

Scissors and shearing tools have long been used for numerous shearing tasks including paper cutting and food preparation, for example. When used for food preparation, scissors such as kitchen shears may include areas, such as between the scissor arms, that are difficult to thoroughly clean.

Scissors which can be disassembled for cleaning have been heretofore known but suffer various disadvantages. For example, certain disassemblable scissor designs require a user to remove a nut or other fastener at the scissors pivot point. The fasteners are generally small and can be easily dropped or lost. Removal and installation of the fasteners can be cumbersome and increase the risk of a cutting injury, for example, if users have limited manual dexterity.

Pivoting hand tools are heretofore known in which a pair of pivotable arms can be disassembled upon aligning a tabbed post on one of the arms with a slotted keyway on the other arm. For example, U.S. Pat. No. 2,619,965 describes a special purpose scissors having a tabbed post which can be disassembled upon opening the arms to an angular displacement beyond the normal range of use. This design may be suitable for special purposes requiring a relatively narrow range of angular displacements but is unsuitable for certain uses such as kitchen shears, for example wherein a wider range of angular displacements could allow accidental disassembly during normal use.

It would be desirable to provide an easily manufacturable means for controlling the angular position of disassemblable scissor arms to allow easy disassembly and reassembly and to prevent accidental disassembly during use.

SUMMARY OF THE INVENTION

Illustrative embodiments of the present invention provide a disassemblable pivoting hand tool such as, for example, scissors including handle structures which control the relative angular position of pivotable arms to allow disassembly and reassembly and to prevent accidental disassembly during use.

In an illustrative embodiment, the handle structure includes an elastic interference portion which provides an interference between the first arm and second arm at the first predetermined angle to prevent angular displacement of the arms from exceeding a predetermined angle until a disassembly pivoting force is applied to the first arm and the second arm. The elastic interference portions are deflected to release the interference upon application of the disassembly pivoting force. Upon being deflected the elastic interference portions apply an axial disassembly force to the first arm and the second arm.

BRIEF DESCRIPTION OF THE DRAWINGS

The foregoing and other features and advantages of the present invention will be better understood from the following detailed description of illustrative embodiments, taken in conjunction with the accompanying drawings in which.

DETAILED DESCRIPTION OF THE DRAWINGS

Figure 1:
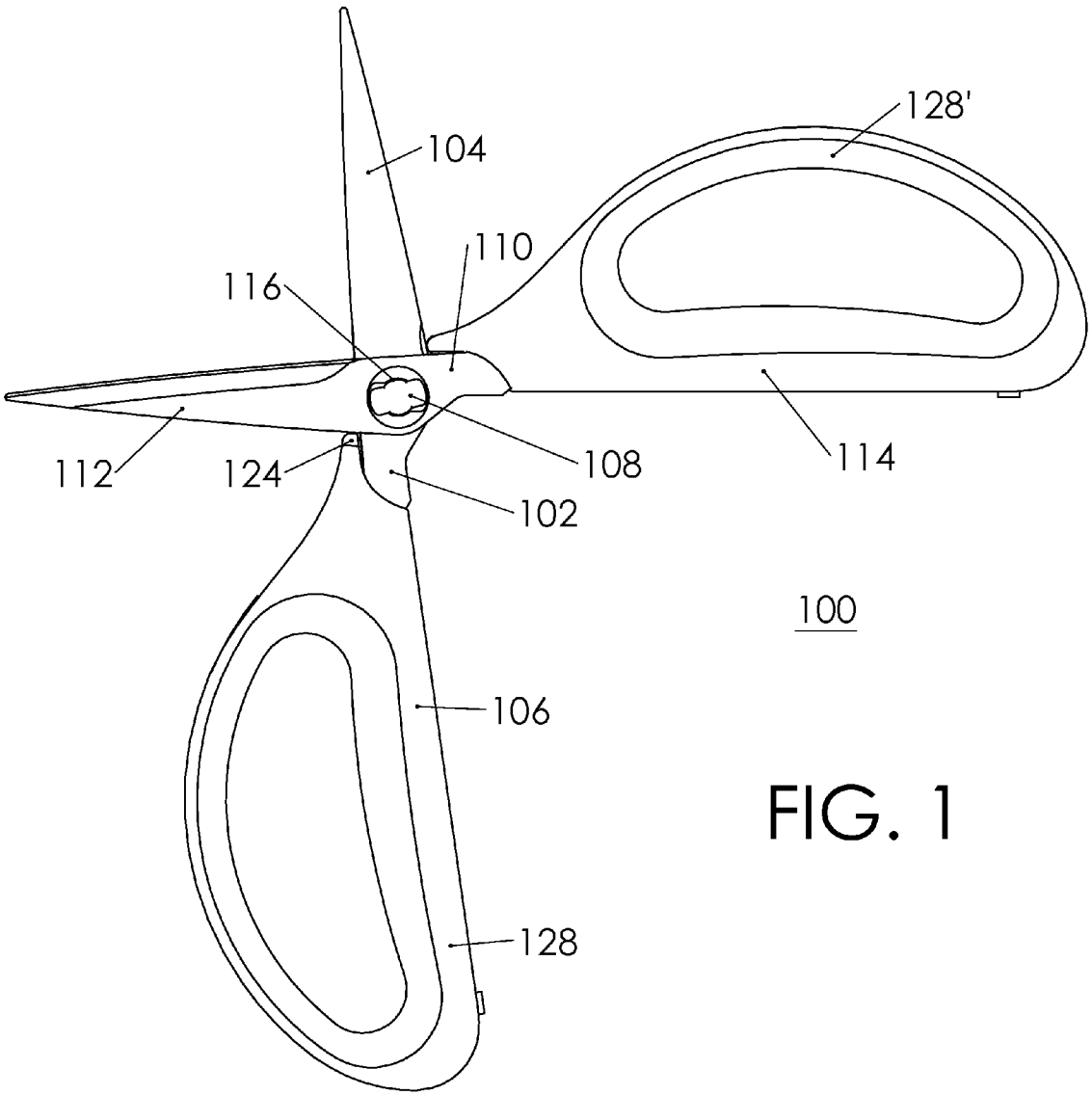
FIG. 1 is a front plan view of a disassemblable-reassemblable scissors in accordance with an illustrative embodiment of the invention.

A disassemblable-reassemblable scissors according to an illustrative embodiment of the invention is described with reference to FIG. 1. The scissors 100 includes a first arm 102 including a first cutting portion 104, a first handle portion 106 and a post 108 protruding from a pivot point between the first cutting portion 104 and the first handle portion 106. A second arm 110 includes a second cutting portion 112, a second handle portion 114, and an aperture 116 between the second cutting portion 112 and the second handle portion 114.

Figure 2:
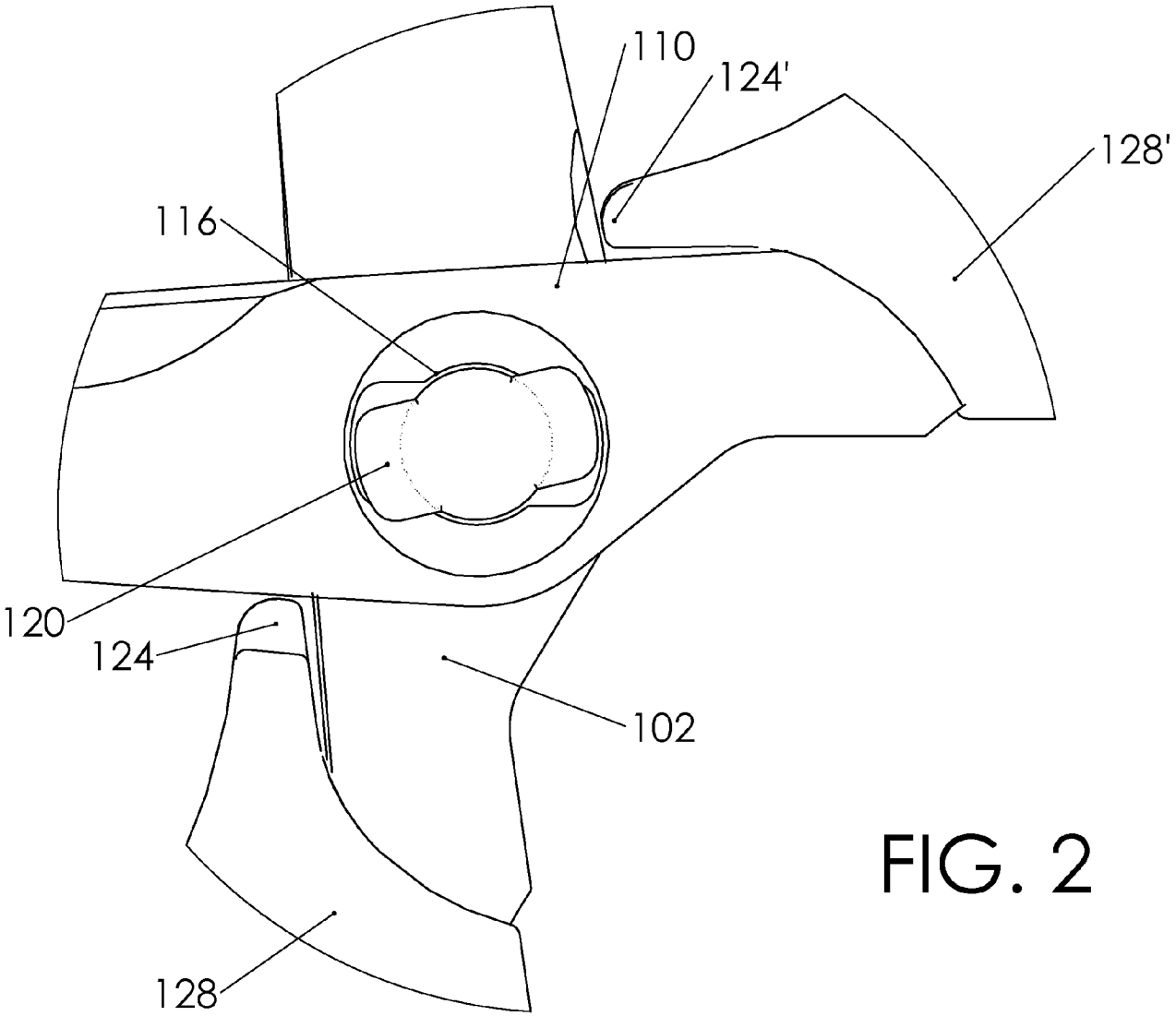
FIG. 2 is a detail plan view of aperture, post and interference portions of a scissors according to an illustrative embodiment of the invention disposed in an open orientation.
Figure 3:
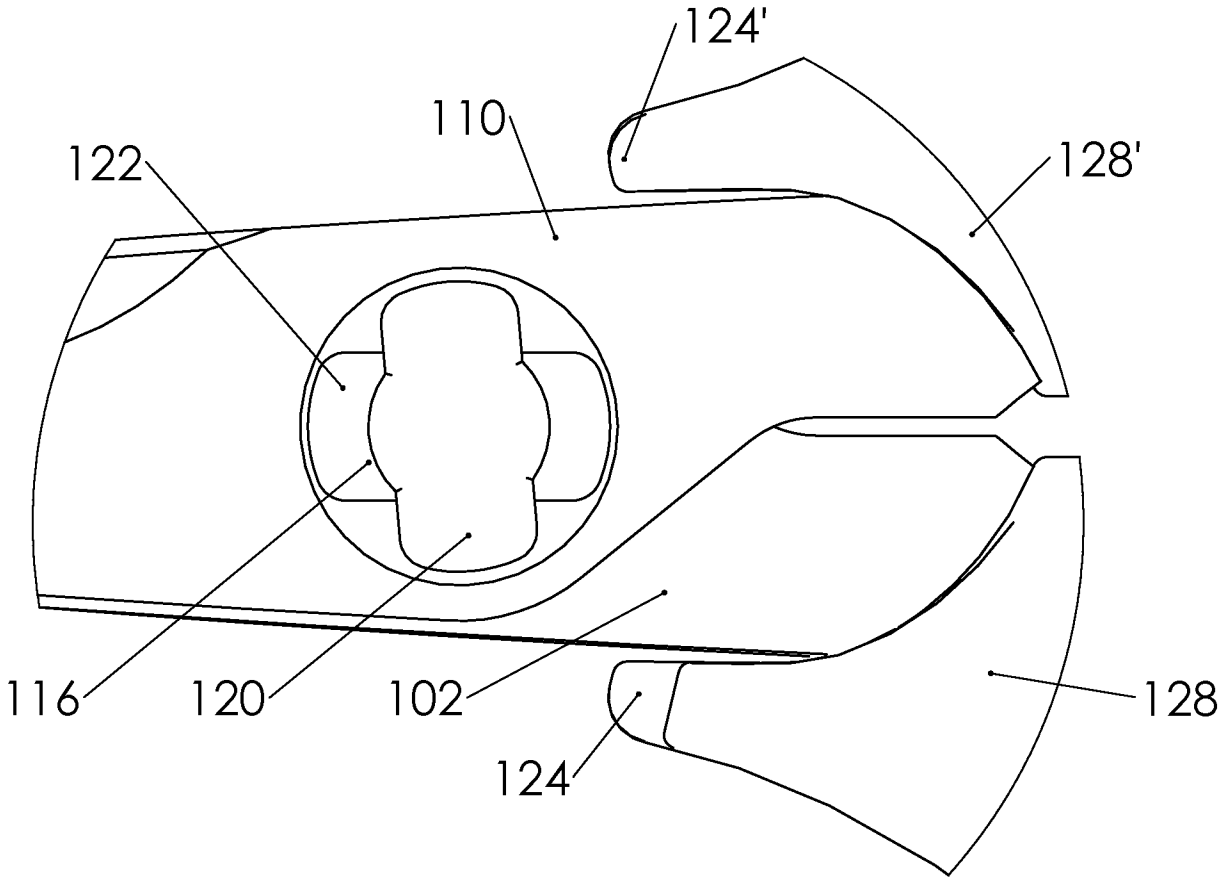
FIG. 3 is a detail plan view of aperture, post and interference portions of a scissors according to an illustrative embodiment of the invention disposed in a closed orientation.

FIGS. 2 and 3 provide enlarged views of an area of the scissors surrounding the post 108 wherein FIG. 3 shows the scissors in their closed orientation and FIG. 2 shows the scissors in their open orientation. The post 108 includes a shaft portion 118 extending through the aperture 116 to pivotably engage the first arm 102 with the second arm 110 for relative angular displacement between the first arm 102 and the second arm 110 about the pivot point. The post also including at least one tab portion 120 extending over at least one edge of the aperture 116 to retain the first arm 102 against the second arm 110.

As can be best seen with reference to FIG. 3, the aperture 116 includes at least one keyway 122 providing clearance for the tab portion 120 during assembly and disassembly of the first arm 102 from the second arm 110. The keyway 122 and tab 120 are oriented such that alignment for clearance between the keyway 122 and tab 120 occurs only when the angular displacement between the first arm 102 and the second arm 110 exceeds a first predetermined angle.

At least one elastic interference portion 124, 124' is attached to at least one of the first arm 102 and second arm 110. The elastic interference portion 124, 124' provides an interference 15 between the first arm 102 and second arm 110 at the predetermined angle to prevent the angular displacement from exceeding the predetermined angle until a substantial pivotal disassembly force is applied to the first arm 102 and the second arm 110. In an illustrative embodiment, the predetermined angle is between about 70 degrees and 80 degrees. The tab 120 aligns with the keyway 122 at an angular displacement of between about 80 degrees and 90 degrees.

In the illustrative embodiment, the elastic interference portion 124, 124' is deflectable to release the interference upon application of at least the disassembly pivoting force to the first arm 102 and the second arm 110. Once the interference is released, the angular displacement may exceed the predetermined angle to allow alignment between the keyway 122 and tab 120. Upon alignment of the keyway 122 and tab 120, the first arm may be separated from the second arm.

In an illustrative embodiment, a disassembly force in a direction axial to the post 108 is applied to the first arm 102 and second arm 110 by the deflected interference portions, 124, 124'. The axial disassembly force urges tab 120 into the keyway 122 and initiates separation of the first arm 102 from the second arm 110. The first arm 102 and second arm 110 may then be easily lifted apart.

In an illustrative embodiment, the tab portion includes two opposing tabs and the keyway includes two opposing slots which are alignable with the two opposing tabs. The post 108 and tab portions 120 may be formed integrally with the first arm 102, for example, or may be formed separately and fixedly attached to the first arm 102.

At least one handle structure 128, 128' is mounted to at least one of the first handle portion 106 and the second handle portion 114. In the illustrative embodiment, the elastic interference portion 124, 124' is formed with the handle structure 128. The handle structure may be made of an elastic material, such as, for example, an elastomer or a soft plastic.

Figure 4:
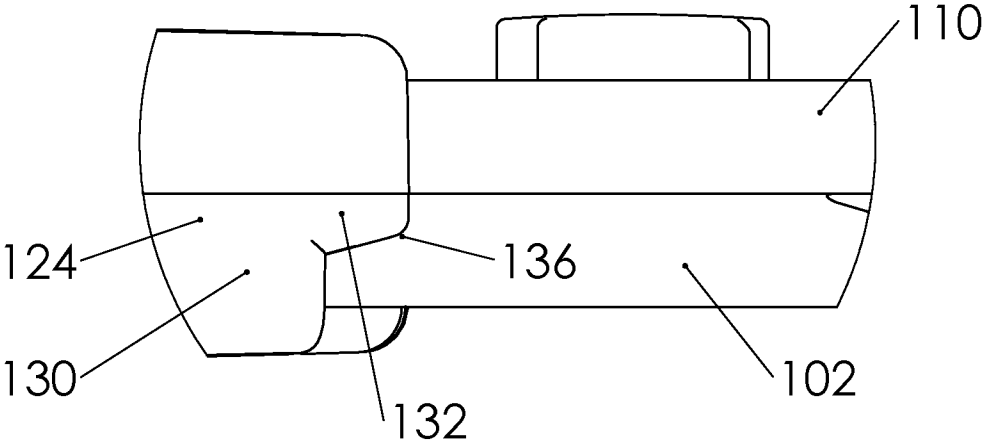
FIG. 4 is a detail profile view of an interference portion of a scissors according to an illustrative embodiment of the invention.

In the illustrative embodiment, the elastic interference portions 124, 124' are formed as extensions of the handle structure 128, 128' with a stepped profile which is best seen with reference to FIG. 4. The stepped profile 130 includes an outer step 132 having a thickness adapted to allow deflection of the outer step 132 by an opposing arm in response to the disassembly pivoting force. In the illustrative embodiment, an outer edge of the outer step includes at least one ramp portion 136 to aid deflection of the elastic interference portion 124 upon contact with the opposing arm.

The elastic interference portion 124, 124' is deflectable by an opposing arm 102, 110 to reassemble the first arm 102 to the second arm 110 upon application of at least a reassembly force to the first arm 102 and the second arm 110 in a direction axial to the post 108. The elastic inference portion 124, 124' is configured to biased to a non-deflected position upon reassembly in response to the angular displacement of the first arm 102 and second arm 110 decreasing below the first predetermined angle.

Although the illustrative embodiments have been described herein with reference to a scissors, persons having skill in the art will appreciate that various other types of pivoting hand tools, such as pliers, clamps or the like, can be provided with elastic interference portions incorporated with handle within the scope of the present disclosure.

In a more general example, an illustrative embodiment prevention provides a pivoting hand tool. The pivoting hand tool includes a first arm including a first distal portion, a first proximal portion and a post protruding from a pivot point between the first distal portion and the first proximal portion. A second arm includes a second distal portion, a second proximal portion, and an aperture between the second distal portion and the second proximal portion. The post includes a shaft portion extending through the aperture to pivotably engage the first arm with the second arm for relative angular displacement between the first arm and the second arm about the pivot point.

In the example, the post includes at least one tab portion including two opposing tabs extending over at least one edge of the aperture to retain the first arm against the second arm. The aperture includes at least one keyway including two opposing slots providing clearance for the tab portion during assembly and disassembly of the first arm from the second arm. The keyway and tab are oriented such that alignment for clearance between the keyway and tab occurs only when the angular displacement between the first arm and the second arm exceeds a predetermined angle.

In the example, at least one handle structure is made of an elastic material and mounted to at least one of the first distal portion and the distal handle portion. At least one elastic interference portion is formed with the handle structure. The elastic interference portion provides an interference between the first arm and second arm at the predetermined angle to prevent the angular displacement from exceeding the first predetermined angle until a disassembly pivoting force is applied to the first arm and the second arm. The elastic interference portion is deflectable to release the first interference upon application of at least the disassembly pivoting force to the first arm and the second arm. The elastic interference portion is deflectable by an opposing arm to reassemble the first arm to the second arm upon application of at least a reassembly force to the first arm and the second arm.

The elastic interference portions have a thickness selected to allow deflection of the elastic interference portions by an opposing arm in response to a predetermined disassembly pivoting force.

While the invention has been described with reference to an exemplary embodiment, it will be understood by those skilled in the art that various changes, omissions and/or additions may be made and equivalents presently available or as yet devised may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed for carrying out this invention, but that the invention will include all embodiments falling within the scope of the appended claims. Moreover, unless specifically stated any use of the terms first, second, etc. do not denote any order or importance, but rather the terms first, second, etc. are merely used to distinguish one element from another.

The invention claimed is:

1. A scissors comprising:

a first arm including a first cutting portion, a first handle portion and a post protruding from a pivot point between the first cutting portion and the first handle portion;

a second arm including a second cutting portion, a second handle portion, and an aperture between the second cutting portion and the second handle portion;

the post including a shaft portion extending substantially through the aperture to pivotably engage the first arm with the second arm for relative angular displacement between the first arm and the second arm about the pivot point;

the post including at least one tab portion extending substantially over at least one edge of the aperture to retain the first arm against the second arm;

the aperture including at least one keyway providing clearance for the tab portion during assembly and disassembly of the first arm from the second arm;

the keyway and tab oriented such that alignment for clearance between the keyway and tab occurs only when the angular displacement between the first arm and the second arm exceeds a predetermined angle; and at least one elastic interference portion coupled to at least one of the first arm and second arm, the elastic interference portion providing an interference between the first arm and second arm at the predetermined angle to prevent the angular displacement from exceeding the predetermined angle until a disassembly pivoting force is applied to the first arm and the second arm to deflect the at least one elastic interference portion and allow the angular displacement between the first arm and the second arm to exceed the predetermined angle, thus permitting the removal of the first arm from the second arm.

2. The scissors of claim 1 wherein the elastic interference portion is adapted to be deflectable to release the interference upon application of at least the disassembly pivoting force to the first arm and the second arm.

3. The scissors of claim 2, wherein the elastic interference portion is configured to apply a disassembly force axial to the post when deflected upon the angular displacement exceeding the predetermined angle.

4. The scissors of claim 1 further comprising at least one handle structure mounted to at least one of the first handle portion and the second handle portion, wherein of the elastic interference portion is formed with the handle structure.

5. The scissors of claim 4 wherein the at least one handle structure is made of an elastic material.

6. The scissors of claim 4 wherein the at least one handle structure is made from a soft plastic.

7. The scissors of claim 4 wherein the at least one handle structure is made from an elastomeric material.

8. The scissors of claim 4 wherein the elastic interference portion is formed as an extension of the handle structure having a thickness selected to allow deflection of the interference portion by an opposing arm in response to the disassembly pivoting force.

9. The scissors of claim 8 wherein an outer edge of the interference portion includes at least one ramp portion to aid deflection of the elastic interference portion upon contact with the opposing arm.

10. The scissors of claim 1 wherein the at least one tab portion comprises two opposing tabs, and wherein the at least one keyway includes two opposing slots which are alignable with the two opposing tabs.

11. The scissors of claim 1 wherein the elastic interference portion is adapted to be deflectable by an opposing arm to reassemble the first arm to the second arm upon application of a pivotal reassembly force to the first arm and the second arm, wherein the reassembly force is applied in a direction axial to the post.

12. The scissors of claim 11 wherein the elastic inference portion is biased to a non-deflected position upon reassembly in response to the angular displacement decreasing below the first predetermined angle.

13. The scissors of claim 1 wherein the predetermined angle is between about 70 degrees and 80 degrees.

14. The scissors of claim 1 wherein the keyway is aligned with the tab when the angular displacement is between about 80 degrees and 90 degrees.

15. The scissors of claim 1 wherein the post and tab portions are formed integrally with the first arm.

16. The scissors of claim 1 wherein the post and tab are coupled to the first arm.

17. A scissors comprising:

a first arm including a first cutting portion, a first handle portion and a post protruding from a pivot point between the first cutting portion and the first handle portion;

a second arm including a second cutting portion, a second handle portion, and an aperture between the second cutting portion and the second handle portion;

the post including a shaft portion extending substantially through the aperture to pivotably engage the first arm with the second arm for relative angular displacement between the first arm and the second arm about the pivot point;

the post including at least one tab portion including two opposing tabs extending substantially over at least one edge of the aperture to retain the first arm against the second arm;

the aperture including at least one keyway having two opposing slots providing clearance for the tab portion during assembly and disassembly of the first arm from the second arm;

the keyway and tab adapted such that alignment for clearance between the keyway and tab occurs when the angular displacement between the first arm and the second arm exceeds a predetermined angle; and at least one elastic interference portion attached to at least one of the first arm and second arm, the elastic interference portion providing an interference between the first arm and second arm at the predetermined angle to prevent the angular displacement from exceeding the first predetermined angle until a disassembly pivoting force is applied to the first arm and the second arm, the elastic interference portion deflectable to release the first interference upon application of at least the disassembly pivoting force to the first arm and the second arm, and the elastic interference portion deflectable by a opposing arm upon to reassemble the first arm to the second arm upon application of at least a reassembly force to the first arm and the second arm;

at least one handle structure made of an elastic material and mounted to at least one of the first handle portion and the second handle portion, wherein the elastic interference portion is formed with the handle structure;

wherein the elastic interference portion is formed as an extension of the handle structure having a thickness selected to allow deflection of the interference portion by an opposing arm in response to the disassembly pivoting force, wherein an outer edge of the interference portion includes at least one ramp portion to aid deflection of the elastic interference portion upon contact with the opposing arm.

18. A pivoting hand tool, comprising:

a first arm including a first work engaging tool portion, a first handle portion and a post protruding from a pivot point between the first work engaging tool portion and the first handle portion; a second arm including a second distal work engaging tool portion, a second proximal handle portion, and an aperture between the second work engaging tool portion and the second proximal handle portion;

a second arm including a second distal portion, a second proximal portion, and an aperture between the second distal portion and the second proximal portion;

the post including a shaft portion extending through the aperture to pivotably engage the first arm with the second arm for relative angular displacement between the first arm and the second arm about the pivot point;

the post including at least one tab portion including two opposing tabs extending over at least one edge of the aperture to retain the first arm against the second arm;

the aperture including at least one keyway having two opposing slots providing clearance for the tab portion during assembly and disassembly of the first arm from the second arm;

the keyway and tab oriented such that alignment for clearance between the keyway and tab occurs only when the angular displacement between the first arm and the second arm exceeds a first predetermined angle; and at least one handle structure made of an elastic material and mounted to at least one of the first and second handle portions;

at least one elastic interference portion formed with the handle structure, the elastic interference portion providing an interference between the first arm and second arm at the predetermined angle to prevent the angular displacement from exceeding the predetermined angle until a disassembly pivoting force is applied to the first arm and the second arm, the elastic interference portion deflectable to release the interference upon application of at least the disassembly pivoting force to the first arm and the second arm, and the elastic interference portion deflectable by a opposing arm to reassemble the first arm to the second arm upon application of at least a reassembly force to the first arm and the second arm.

19. The pivoting hand tool of claim 18 wherein the elastic interference portion is configured to apply a disassembly force axial to the post when deflected upon the angular displacement exceeding the predetermined angle.

20. The pivoting hand tool of claim 19 wherein the elastic interference portion is formed as an extension of the handle structure having a thickness selected to allow deflection of the elastic interference portion by an opposing arm in response to the disassembly pivoting force.

* * * * *

UNITED STATES PATENT AND TRADEMARK OFFICE

CERTIFICATE OF CORRECTION

PATENT NO. : 8,424,211 B2
APPLICATION NO. : 12/872607
DATED : April 23, 2013
INVENTOR(S) : Lucas O. Nene et al.

It is certified that error appears in the above-identified patent and that said Letters Patent is hereby corrected as shown below:

In the Claims:

Column 6, line 40 (claim 18, line 6) delete "distal"
Column 6, line 40 (claim 18, line 6) delete "proximal"
Column 6, line 42 (claim 18, line 8) delete "proximal"
Column 6, lines 44-46 (claim 18, lines 10-12) delete "a second arm including a second distal portion, a second proximal portion, and an aperture between the second distal portion and the second proximal portion"

Signed and Sealed this
Second Day of July, 2013

Teresa Stanek Rea
*Acting Director of the United States Patent and Trademark Office*